US006587569B2

(12) United States Patent
Adrion et al.

(10) Patent No.: US 6,587,569 B2
(45) Date of Patent: Jul. 1, 2003

(54) DIFFERENTIAL-PRESSURE MICROPHONE

(75) Inventors: Ulrich Adrion, Trossingen (DE); Torsten Harms, Villingen-Schwenningen (DE)

(73) Assignee: Thomson, Licensing, S.A., Boulogne-Billancourt (FR)

( * ) Notice: Subject to any disclaimer, the term of this patent is extended or adjusted under 35 U.S.C. 154(b) by 0 days.

(21) Appl. No.: 09/741,533

(22) Filed: Dec. 20, 2000

(65) Prior Publication Data

US 2001/0005418 A1 Jun. 28, 2001

(30) Foreign Application Priority Data

Dec. 28, 1999 (DE) ..... 199 63 217

(51) Int. Cl.[7] ..... H04R 25/00
(52) U.S. Cl. ..... 381/360; 381/359
(58) Field of Search ..... 381/360, 359, 381/355, 181, 357, 356, 188, 365; 455/92, 563

(56) References Cited

U.S. PATENT DOCUMENTS 2,627,932 A * 2/1953 Volkmann et al.
4,858,719 A 8/1989 Fidi et al.
5,263,093 A 11/1993 Nakamura et al. ..... 381/168
5,410,608 A * 4/1995 Lucey et al.
6,091,830 A * 7/2000 Toki
6,201,876 B1 * 3/2001 Niemi et al.
6,275,595 B1 * 8/2001 Lundgren et al.

FOREIGN PATENT DOCUMENTS

DE 3700594 A1 7/1987 ..... H04R/1/38
DE 19541648 5/1997
DE 19541648 A1 5/1997 ..... H04R/3/00
GB 2218303 A 11/1989 ..... H04R/1/32

* cited by examiner

*Primary Examiner*—Sinh Tran
(74) *Attorney, Agent, or Firm*—Joseph S. Tripoli; Joseph J. Laks; Reitseng Lin

(57) ABSTRACT

The pressure-difference microphone is arranged in a housing, and there is provided in one of the housing walls a single opening, directed onto the front side of the microphone, for feeding voice commands which can be produced in the acoustic near field of the housing. According to the invention, the arrangement of the microphone and/or the air volume which surrounds the microphone in this case are such that the microphone can be irradiated with sound through the opening, using the pressure-difference principle.

3 Claims, 1 Drawing Sheet

DIFFERENTIAL-PRESSURE MICROPHONE

BACKGROUND

The invention relates to a sound pick-up having a pressure-difference microphone, arranged in a housing, for converting acoustic signals which are produced in the acoustic near field of the sound pick-up into an electric signal.

The invention also relates to a remote control unit, in particular for wireless control of equipment by acoustic input of command signals having a pressure-difference microphone arranged in the housing of the remote control unit.

A known field of application of such sound pick-ups relates, for example, to voice communication in a noisy environment. On the basis of the pressure-difference principle applied in this case, sound produced in the acoustic far field of the sound pick-up can be faded out or at least reduced so far that words spoken in the acoustic near field of the sound pick-up can be transmitted virtually undistorted for the purpose of intelligibility.

Because of these properties, such sound pick-ups are also suitable for remote control devices with voice input of control commands, called voice commands below, into an appropriate remote control unit. However, it has been shown that breathing noises and the manner of pronunciation of specific command words can lead to misinterpretation of a voice command—such as,"p", in the case of a command word with a consonant which is pronounced hard.

It is therefore the object of the invention to improve intelligibility in the case of a sound pick-up and to improve the recognition of command words in the case of a remote control device with such a sound pick-up.

SUMMARY OF THE INVENTION

The invention is based on the idea of arranging a pressure-difference microphone in a housing, and of providing in one of the housing walls a single opening directed onto the front side of the microphone, for feeding voice commands which can be produced in the acoustic near field of the housing, the aim being to arrange the microphone in the housing in such a way that, and/or to form the air volume which is to surround the microphone, in such a way that the microphone can be irradiated with sound through the opening, using the pressure-difference principle.

This configuration of the sound pick-up has the advantage, moreover, that a wind shield or the like can additionally be arranged in a simple way between the opening and the microphone.

BRIEF DESCRIPTION OF THE DRAWINGS

The invention is explained in more detail with the aid of an exemplary embodiment. In the drawing.

DETAILED DESCRIPTION

Figure 1B:
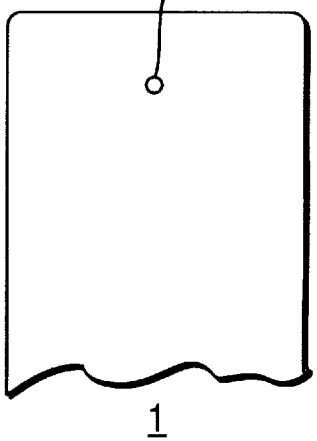
FIG. 1 shows a remote control with a sound pickup.
Figure 1A:
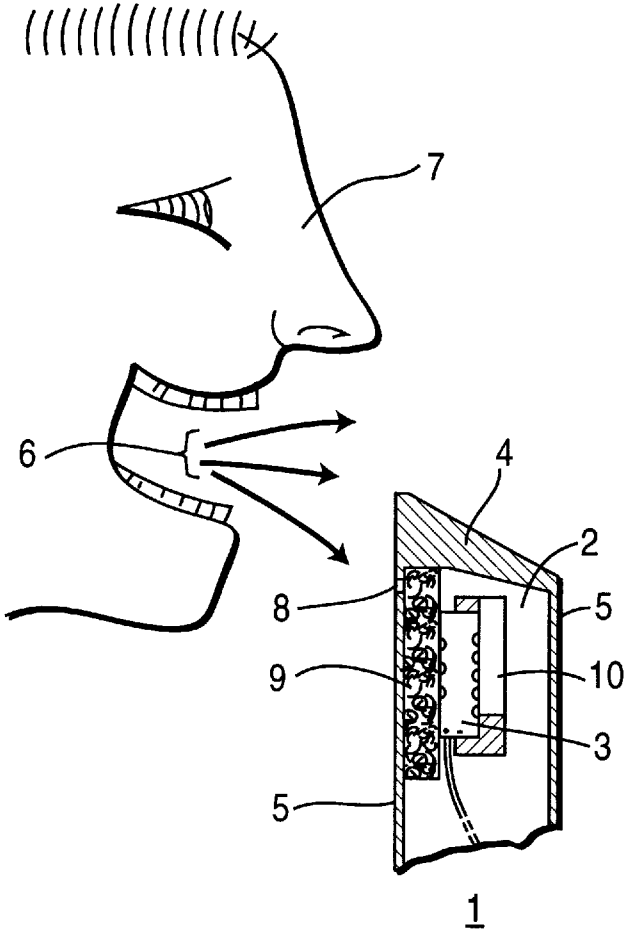

FIG. 1 shows with the aid of interconnected sketches a) and b) a remote control unit 1 of a remote control device (not illustrated) with a voice command input. It may be noted that in this case it is only the elements required to understand the invention which are illustrated.

Sketch a) shows a sectional illustration of the top part of the remote control unit 1, which is designed according to the invention as a sound pick-up device. The structural principle of this sound pick-up device, termed sound pick-up below, can also be applied, according to the invention, to non-enclosed sound pick-ups, for example in combined intercommunication systems serving to communicate in a noisy environment, also called headsets. Sketch b) is a frontal illustration of the remote control device 1.

Figure 2:
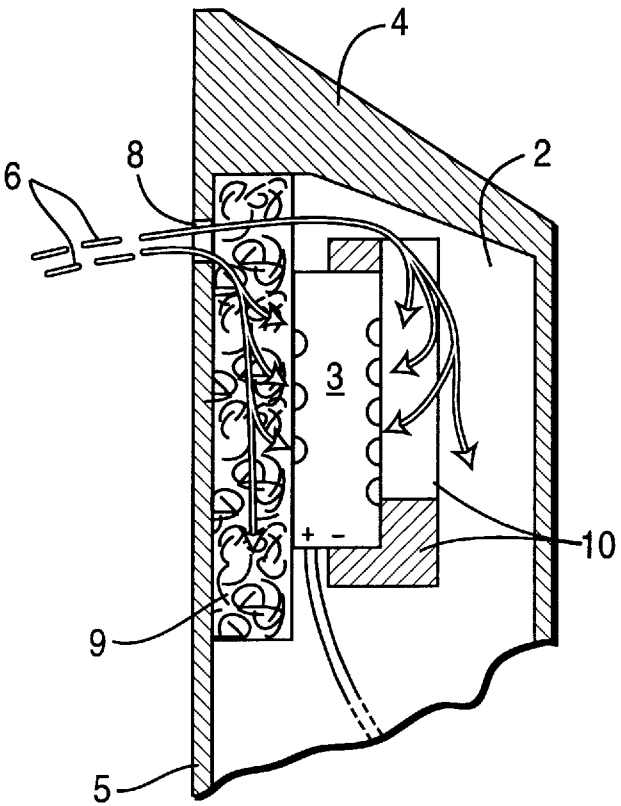
FIG. 2 shows the remote control on an enlarged scale.

FIG. 2 shows a sectional illustration of the upper part of the remote control unit 1 on an enlarged scale with the sound pressure distribution on a pressure-difference microphone 3 of cuboid design, which is preferably mounted in a self-closed fashion in a rubber-like frame. Mutually corresponding parts are provided in this case with the same reference symbols. The frame 10 is arranged inside the remote control unit 1 by means of a holder (not illustrated) which is formed on the housing of the remote control unit 1.

In principle, the sound pick-up is formed with the pressure-difference microphone 3 arranged in a cavity 2. The cavity 2 forms in this case the upper housing wall 4 in conjunction with the lateral housing wall 5 of the remote control unit 1. The pressure-difference microphone 3 is arranged in the cavity 2 by means of the aforesaid holder and frame 10 in such a way that an acoustic signal 6 directed onto the front side of the microphone 3 and produced as a voice command by a voice command speaker 7 in the acoustic near field of the sound pick-up can flow virtually completely around the microphone 3, a single opening 8, directed onto the front side of the microphone 3, being provided in one of the housing walls 5 for feeding the signal. As a result, according to the invention the microphone 3 is irradiated with sound through the opening 8 using the pressure-difference principle.

The opening 8 is preferably of tubular design in the housing wall 5. Moreover, the size and arrangement of the opening 8 are matched to one another with reference to the microphone 3 and/or the air volume which surrounds the microphone 3 in the housing. The size and arrangement of the opening 8 can be determined empirically for example. It has emerged that in the case of the size relationship to be gathered from sketch a) a diameter of virtually 2 mm leads to optimum results.

The pressure-difference principle for irradiating the microphone 3 with sound is maintained owing to the arrangement according to the invention of the microphone 3 in conjunction with the signal feed according to the invention, in particular that to be gathered from FIG. 2. Consequently, intelligibility can be enhanced in conjunction with a sound pick-up serving merely for communication, and the command word recognition is improved in conjunction with a remote control device based on processing voice commands.

In a development of the invention, a wind shield 9 is additionally provided between the opening 8 and the microphone 3. The wind shield 9 preferably consists of a foamed plastic or the like which is known per se and damps noise. Such a foamed plastic is also termed an acoustic foamed plastic. In this case, the shaping and arrangement of the wind shield 9 in the cavity 2 are such that the irradiation of the microphone 3 with sound is brought about virtually entirely through the wind shield 9. It is possible with the aid of this measure for undesired acoustic signal components such as, in particular, consonants pronounced hard in a voice command to be damped according to the invention, and this contributes to a further improvement in the command word recognition.

What is claimed is:

1. A remote control for wireless control of equipment via acoustic input of voice command signals, comprising:

a pressure-difference microphone for converting said voice command signals into corresponding electric signals; and a housing comprising:

a cavity formed in said housing for arranging said microphone, one single opening in a housing wall of said housing in front of the front side of said microphone for feeding the voice command signals;

a wind shield consisting of acoustic foamed plastic which is arranged between said opening and said microphone, for damping of undesired acoustic signal components in said voice command signals; and an air volume surrounding said microphone in the cavity of said housing; and wherein said microphone is irradiated with sound according to the pressure-difference principle through said single opening, said wind shield and said air volume.

2. The remote control according to claim 1 wherein the size and arrangement of said opening are matched to one another with reference to said microphone or air volume surrounding said microphone in the cavity of said housing.

3. The remote control according to claim 1 wherein the size and arrangement of said opening can be determined empirically with reference to said microphone or air volume surrounding said microphone in the cavity of said housing.

* * * * *